US009926699B2

(12) United States Patent
Ben David

(10) Patent No.: US 9,926,699 B2
(45) Date of Patent: Mar. 27, 2018

(54) THERMAL EXPANSION RETENTION CLIP

(71) Applicant: DAN-PAL, Kibbutz Dan (IL)

(72) Inventor: Micha Ben David, Upper Galil (IL)

(73) Assignee: Dan-Pal, Kibbutz Dan (IL)

( * ) Notice: Subject to any disclaimer, the term of this patent is extended or adjusted under 35 U.S.C. 154(b) by 0 days.

(21) Appl. No.: 15/088,180

(22) Filed: Apr. 1, 2016

(65) Prior Publication Data

US 2016/0215504 A1 Jul. 28, 2016

Related U.S. Application Data

(63) Continuation-in-part of application No. PCT/IL2014/050866, filed on Oct. 2, 2014.
(Continued)

(30) Foreign Application Priority Data

Apr. 2, 2015 (IL) ..... 238134

(51) Int. Cl.
*E04B 1/68* (2006.01)
*E04D 3/363* (2006.01)
(Continued)

(52) U.S. Cl.
CPC ..... *E04B 1/68* (2013.01); *E04D 3/363* (2013.01); *E04F 13/0841* (2013.01);
(Continued)

(58) Field of Classification Search
CPC ... E04D 2003/285; E04D 3/361; E04D 3/366; E04D 3/363; E04D 2003/3615
(Continued)

(56) References Cited

U.S. PATENT DOCUMENTS 390,806 A 10/1888 Sagendorph
1,826,133 A * 10/1931 Hatch ..... E04B 9/26 292/19
(Continued)

FOREIGN PATENT DOCUMENTS

EP 2738319 A1 * 6/2014 ..... B25B 23/00
JP S50-115416 U 9/1975
(Continued)

OTHER PUBLICATIONS

European Patent Office, International Search Report in International Application No. PCT/IL2014/050866 (dated Jan. 29, 2015).
(Continued)

*Primary Examiner* — Babajide A Demuren
(74) *Attorney, Agent, or Firm* — Leydig, Voit & Mayer, Ltd.

(57) ABSTRACT

A retention clip for use with a panel system has a base plate having a pair of opposing flanges at least one of which is configured for attaching to a support structure. An upright extends between the base plate and a top plate having a pair of opposing flanges and defines opposing first and second surfaces that in use are dimensioned to engage opposing first and second ends of a pair of first and second adjacent panels. At least the first surface supports a spacer element that is configured to prevent mutual abutment of opposing ends of the first and second panels at least during construction of the panel system.

20 Claims, 5 Drawing Sheets

Related U.S. Application Data

(60) Provisional application No. 61/886,109, filed on Oct. 3, 2013.

(51) Int. Cl.

| | |
|---|---|
| ***E04F 13/08*** | (2006.01) |
| ***E04F 13/18*** | (2006.01) |
| *E04D 3/366* | (2006.01) |
| *E04D 3/361* | (2006.01) |
| *E04D 3/28* | (2006.01) |

(52) U.S. Cl.
CPC ..... *E04F 13/18* (2013.01); *E04D 3/361* (2013.01); *E04D 3/366* (2013.01); *E04D 2003/285* (2013.01); *E04D 2003/3615* (2013.01)

(58) Field of Classification Search
USPC ..... 52/466, 460, 461, 468
See application file for complete search history.

(56) References Cited

U.S. PATENT DOCUMENTS

| | | | | | |
|---|---|---|---|---|---|
| 4,573,300 | A | | 3/1986 | Bezner | |
| 4,649,684 | A | * | 3/1987 | Petree | E04D 3/366 52/395 |
| 4,679,375 | A | * | 7/1987 | Shirey | E04B 9/068 52/506.07 |
| 5,363,624 | A | * | 11/1994 | Cotter | E04D 3/366 52/466 |
| 6,164,024 | A | * | 12/2000 | Konstantin | E04D 3/08 52/200 |
| 6,374,564 | B1 | * | 4/2002 | Fletterick | F27D 1/004 52/385 |
| 6,523,314 | B1 | * | 2/2003 | LaLonde | E04B 9/005 52/506.07 |
| 6,701,686 | B1 | * | 3/2004 | Platt | E04B 9/02 52/506.07 |
| 6,715,256 | B1 | * | 4/2004 | Fischer | E04D 3/362 52/537 |
| 7,313,893 | B2 | * | 1/2008 | Voegele, Jr. | E04D 3/361 52/461 |
| 7,546,708 | B2 | * | 6/2009 | Konstantin | E04D 3/08 52/200 |
| 7,661,234 | B2 | * | 2/2010 | Voegele, Jr. | E04D 3/363 52/459 |
| 7,788,869 | B2 | * | 9/2010 | Voegele, Jr. | E04D 3/361 52/461 |
| 8,056,289 | B1 | * | 11/2011 | Konstantin | E04D 3/28 52/204.591 |
| 8,713,880 | B2 | * | 5/2014 | Konstantin | E04C 2/543 52/459 |
| 2008/0053026 | A1 | * | 3/2008 | Voegele, Jr. | E04D 3/361 52/582.1 |
| 2009/0049771 | A1 | | 2/2009 | Konstantin | |

FOREIGN PATENT DOCUMENTS

| | | | |
|---|---|---|---|
| JP | S58-150652 | A | 9/1983 |
| JP | S59-24060 | A | 5/1984 |
| JP | S61-200250 | A | 9/1986 |

OTHER PUBLICATIONS

European Patent Office, Written Opinion in International Application No. PCT/IL2014/050866 (dated Jan. 29, 2015).
International Bureau of WIPO, International Preliminary Report on Patentability in International Application No. PCT/IL2014/050866 (dated Sep. 10, 2015).

* cited by examiner

THERMAL EXPANSION RETENTION CLIP

CROSS-REFERENCE TO RELATED APPLICATIONS

This application is a continuation-in-part of International Application No. PCT/IL2014/050866 filed Oct. 2, 2014 which claims the benefit of U.S. Provisional application No. 61/886,109 filed Oct. 3, 2013, the present application further claiming the benefit of Israel Patent Application No. IL 238134 filed Apr. 2, 2015, the disclosures of which are hereby incorporated herein by reference in their entireties and for all purposes.

FIELD OF THE INVENTION

The present invention relates to extruded, modular panel units for the construction of walls, ceilings, roofs, canopies and windows, particularly of light-transmitting sections. More specifically, the invention discloses a retention clip used to fasten such systems to metal constructions (i.e., purlins) while allowing for thermal expansion of the panels.

BACKGROUND OF THE INVENTION

U.S. Pat. No. 7,661,234 to Voegele, Jr. is one of a large family of patents all directed to a panel assembly 10 as shown in FIG. 1 comprising a pair of juxtaposed panels 11, 12 each having at a mating edge thereof a respective upright joining flange 13, 14 that support a sealing cap 15. The panel assembly 10 includes a retention clip 20 that serves both to fixedly attach the panel assembly 10 to a support structure 21 by means of a bolt 22 as well as separating the mating edges of the panels so as to allow for thermal expansion. The retention clip 20 employs a first generally Z-shaped plate 25 and a second generally C-shaped shape 26 which are co-operatively mounted to define a pair of webs or uprights 27 and 27' supported at their lower ends by a common base 29 and defining at their upper ends opposing flanges 30 and 31.

The uprights 27 and 27' define opposing first and second surfaces that engage opposing first and second ends of a pair of first and second adjacent panels, i.e., the panels 11 and 12. Thus, the first and second ends of the adjacent panels are separated by the respective first and second surfaces 27 and 27', which themselves define an intervening gap 32. Thermal expansion of the panels exerts pressure on the respective first and second surfaces of the upright, thereby flexing them towards each other and narrowing the gap without causing the panels to buckle.

The gap 32 between the panels is maintained by a spacer element 33, which ensures that the panels 11 and 12 do not bear tightly against the uprights 27 and 27'. The gap 32 is sufficient to allow longitudinal movement of the panels 11 and 12, such as may result from thermal expansion and contraction of the panels and the sealing cap 15, without causing significant frictional contact between the panels 11 and 12 and the uprights 27 and 27'.

U.S. Pat. No. 7,788,869 also to Voegele, Jr. discloses a similar retention clip but wherein the gap may be maintained by an optional fin that projects downward from the sealing cap and splays apart the uprights 27 and 27'.

The retention or fastening clips taught by Voegele, Jr. are based on two-part constructions that require aligning prior to assembly.

U.S. Pat. No. 6,164,024 to Konstantin shows various retention clips formed for the most part of a single molding. Typically clip is an integral extrusion and can take on a variety of forms in each of which the clip top flange extends continuously from one side of the web to the other so as to be resistant to being bent upward on either side of the web. The clip can be extruded with thickened portions to strength and its base can be integral with the lower supporting structure.

US 2009/0049771 also to Konstantin discloses a glazing panel system with glazing panels, retention clips and/or U-shaped connectors. The retention clip may engage the glazing panels at locations lower than top ends of the upstanding seam flanges. In one embodiment, an internal U-shaped connector is positioned to engage the seam flanges while an external U-shaped connector covers the internal connector and the seam between adjacent glazing panels. The retention clips may be formed with an upper transverse portion that is movable relative to the base portion of the clip to accommodate panel expansion and contraction. Also, a thicker plate or portion may be provided at a top flange for the retention clip to provide increased resistance to uplift loads trying to bend the flange.

In use, the base of the clip is fastened usually with bolts to the purlin or rafter of the roof. The two juxtaposed panels are then assembled one on each side of the clip so as to be displaced from each other with their upwardly directed joining flanges being engaged by respective opposed flanges of the retention clip.

JPS5924060 discloses a retaining clip for retaining adjacent roof panels. The clip has a base plate having a pair of opposing flanges one of which is configured for attaching to a support structure and a top plate having a pair of opposing flanges. An upright extends between the base plate and the top plate and supports on opposing surfaces respective resilient elements that engage a pair of first and second adjacent panels, which are secured by a cap that is mounted over the retaining clip.

US 2009/0049771 discloses a panel system wherein a retention clip engages the panels at locations lower than top ends of the upstanding seam flanges.

SUMMARY OF THE INVENTION

It is an object of the present invention to provide a retention clip for standing seam systems such as shown in U.S. Pat. No. 4,573,300 that will allow for expansion and contraction of polycarbonate panels upon the daily variation in temperature of these long flanged plastic sheets.

It is a further object to provide a retention clip that ensures that the desired gap between adjacent panels can be maintained at least during construction so as to ensure accurate fitting and avoid guesswork that is often required using known approaches.

It is yet a further object to provide a retention clip where the gap is not retained between two spaced apart wall surfaces but is assured by means of a modification to a single wall surface only thus resulting in a simpler construction.

These objects are realized in accordance with the invention by a panel system and a retention clip therefor having the features of the respective independent claims.

BRIEF DESCRIPTION OF THE DRAWING(S)

In order to understand the invention and to see how it may be carried out in practice, embodiments will now be described, by way of non-limiting example only, with reference to the accompanying drawings, in which:

FIG. 1*a* shows pictorially a pair of juxtaposed panels joined via a prior art two-part retention clip;

FIG. 1*b* is a detail of the retention clip shown in FIG. 1*a;*

Figure 6A:
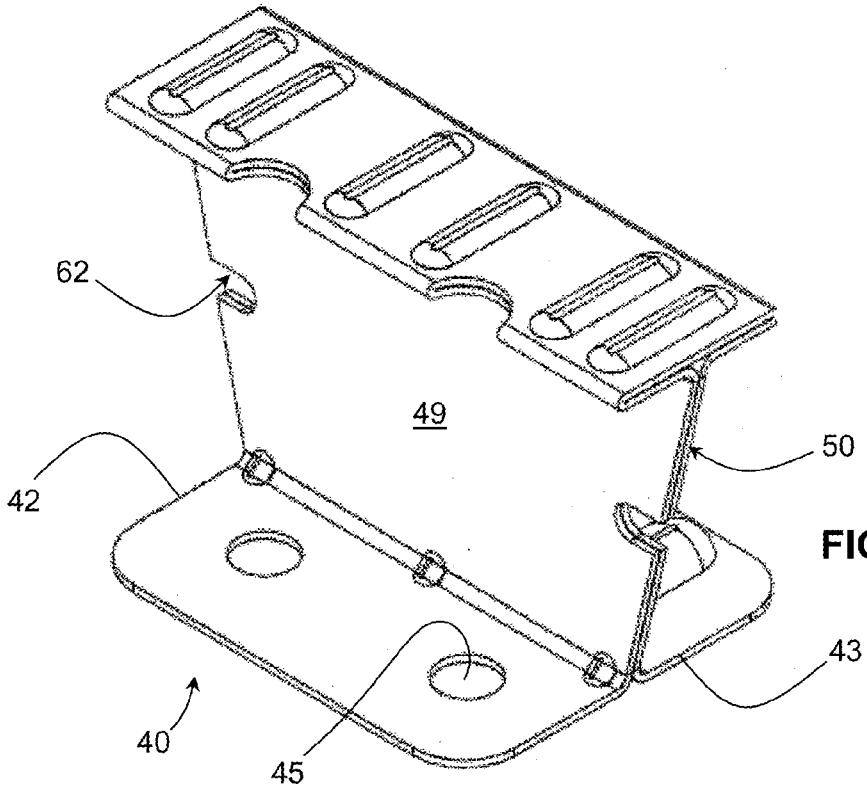
Figure 6B:
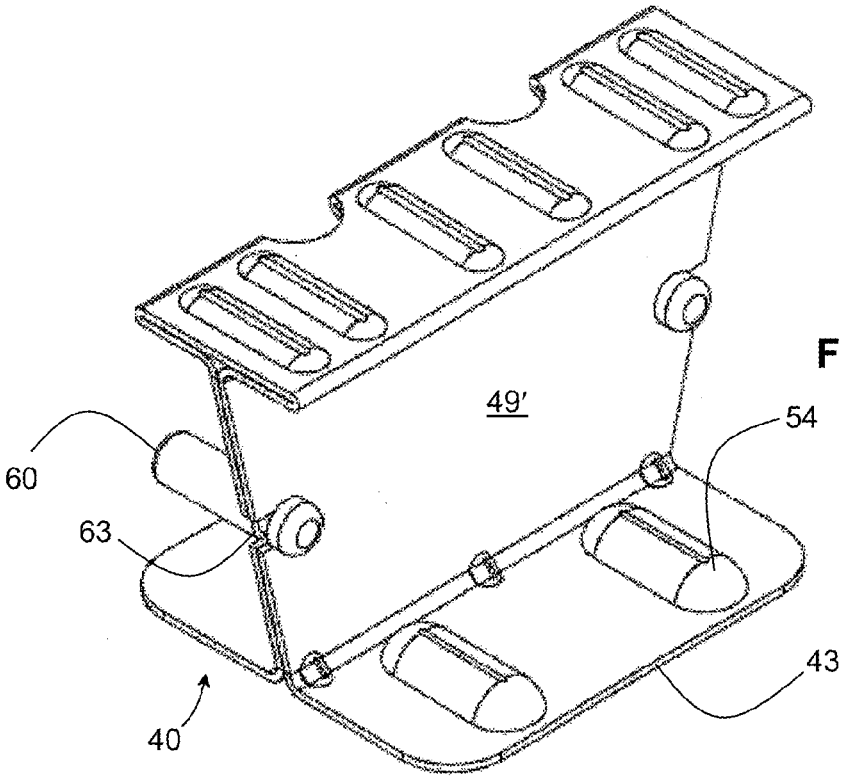
Figure 7A:
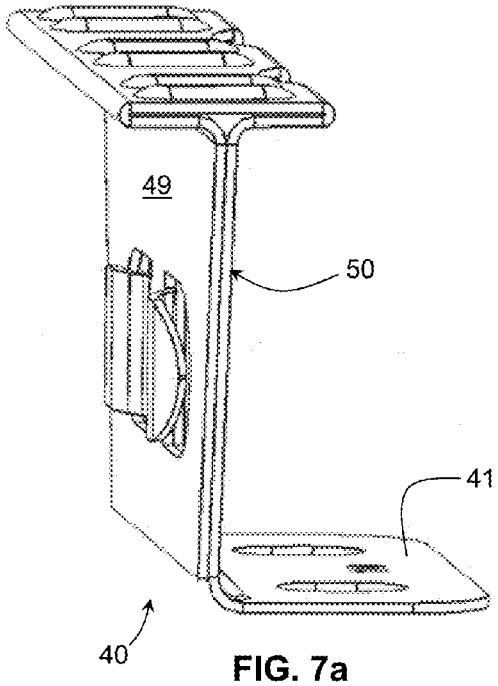
Figure 7B:
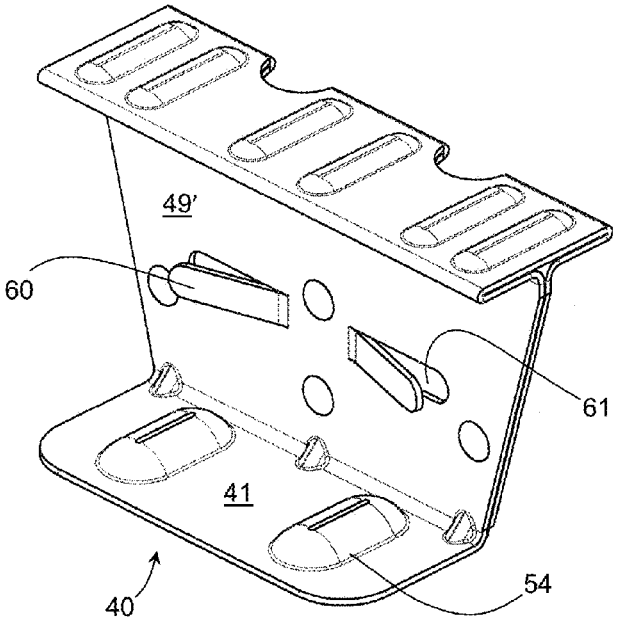
Figure 7C:
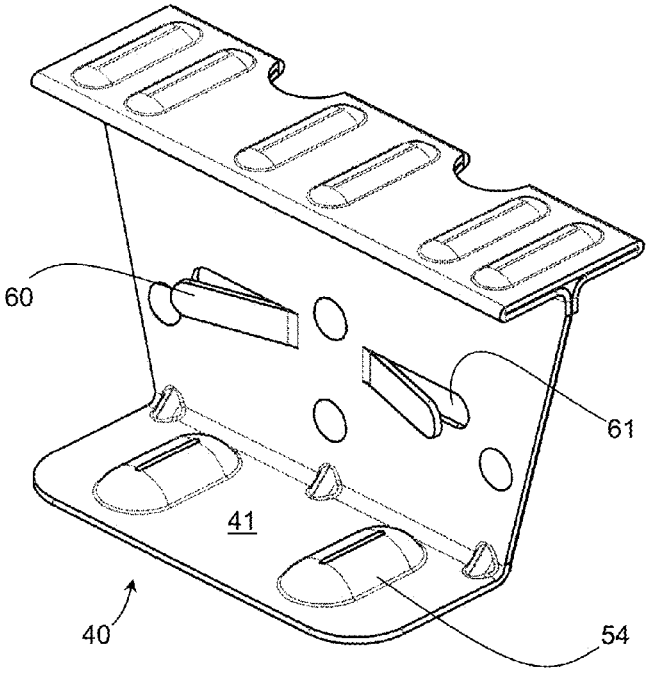

FIGS. 6*a* and 6*b* show front and back views of a retention clip according to another embodiment of the invention; and FIGS. 7*a*, 7*b* and 7*c* show retention clips according to further embodiments of the invention.

DETAILED DESCRIPTION OF THE INVENTION

In the following description of some embodiments, identical components that appear in more than one figure or that share similar functionality will be referenced by identical reference symbols.

Figure 1A:
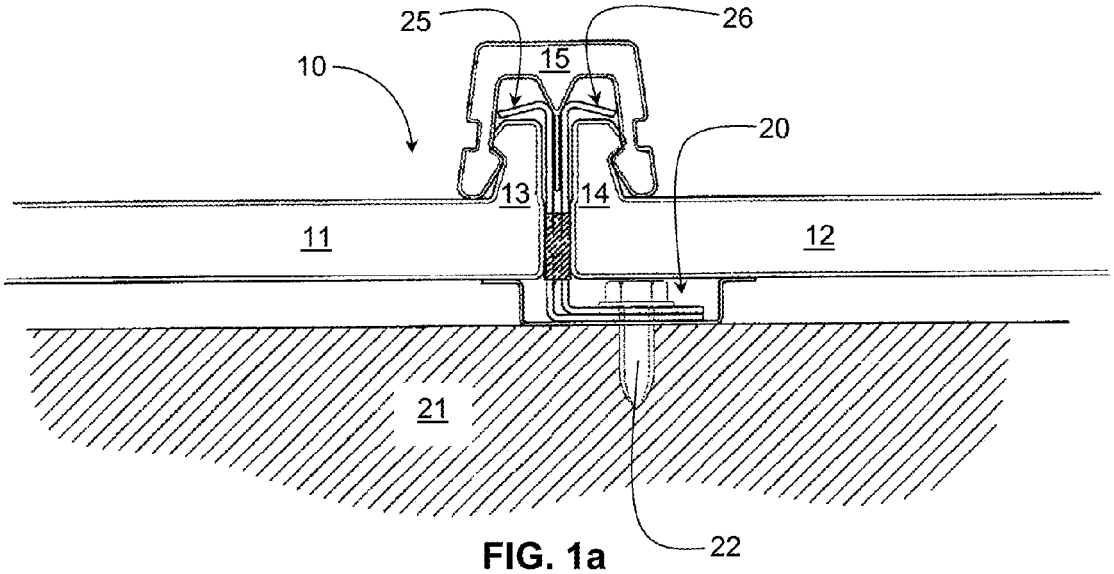
FIG. 1a (PRIOR ART)
Figure 1B:
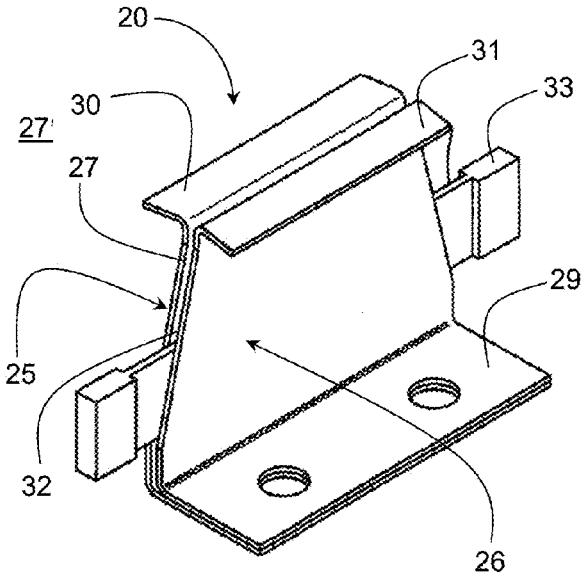
FIG. 1b (PRIOR ART)
Figure 2:
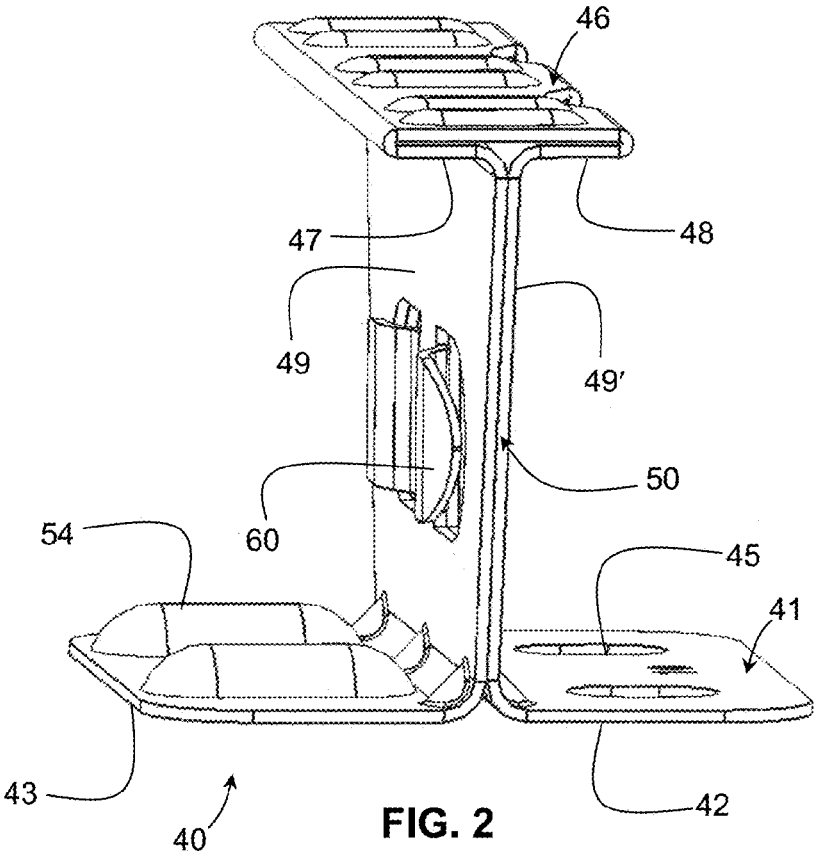
FIG. 2 shows a retention clip according to an embodiment of the invention.

FIG. 2 shows an isometric view of a retention clip 40 according to a first embodiment of the invention. The general structure of the retention clip 40 is similar to that disclosed in above-mentioned U.S. Pat. No. 6,164,024 in that it comprises a base plate 41 having a pair of opposing flanges 42, 43 at least one of which 42 is configured for attaching to a support structure 44 shown in FIG. 3. To this end, the flange 42 may be provided with apertures 45 constituting attachment means allowing the retention clip 40 to be bolted to the support structure 44 in known manner.

The retention clip 40 has a top plate 46 formed of a pair of opposing flanges 47 and 48 and is joined to the base plate 41 via an upright 50 extending between the base plate 41 and the top plate 46. The upright 50 defines opposing first and second surfaces 49 and 49', respectively, that engage opposing first and second ends of a pair of first and second adjacent panels 51 and 52 of a panel system 55 shown in FIG. 3 so as to allow mutual sliding of the panels relative to the retention clip 40, which is fixed to the structure 44. The panels 51 and 52 have respective upwardly projecting flanges 56, 57 that may be indented and support a sealing cap 58 that serves both to seal the joint between the two panels and secure them in interlocked engagement.

It will be apparent that, at least in form, the retention clip 40 as so far described shares much of the structure of the clips described in U.S. Pat. No. 6,164,024 such as FIG. 7 thereof. We shall now explain wherein they differ.

The retention clip 40 according to the invention is characterized by one or more spacer elements 60 emerging from at least one of the first and second surfaces 49, 49' that prevent the first end of the first panel 51 from abutting the second panel 52 at least during construction of the panel system 55. The spacer elements 60 may be resilient fingers or springs and help to reduce friction in the panel system 55 as will be further described below.

Figure 3:
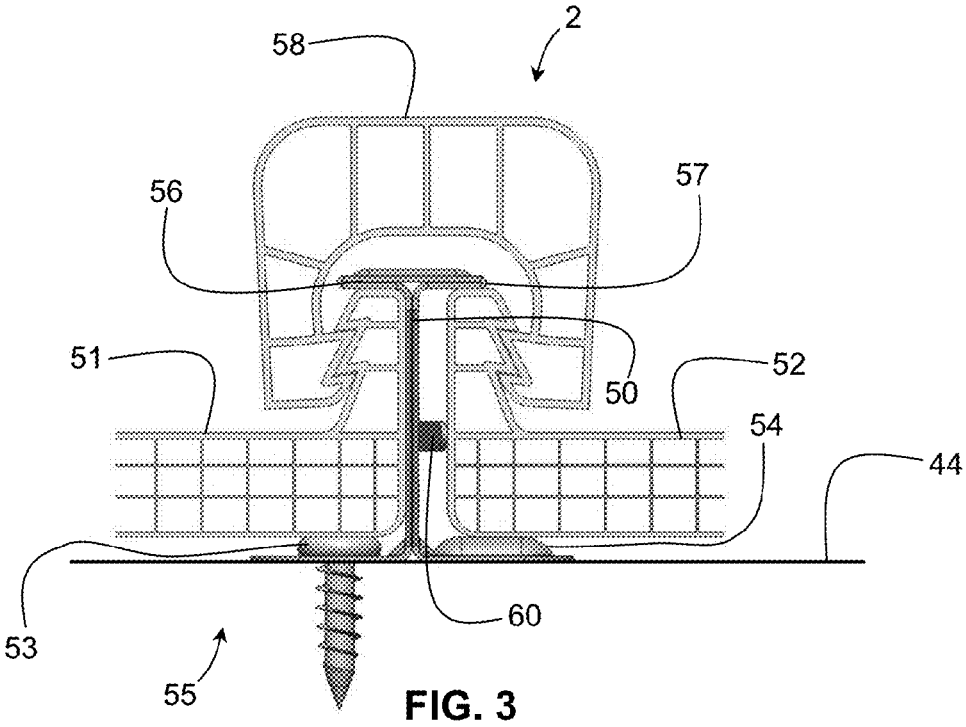
FIG. 3 shows a pair of juxtaposed panels joined via a retention clip according to an embodiment of the invention.

Upon installation, spacer elements 60 dictate a gap between the first panel 51 and the first surface 49 of the clip 40, so that the first panel 51 is free to expand thermally in the lateral direction 14 (as shown in FIG. 3) and thus not apply undue pressure on the first surface 49 of the clip 40 when the temperature of the panel rises. Consequently there is little or no friction between the clip 40 and the panels 51, 52, which are now also free to expand longitudinally (i.e., in a direction normal to the paper in FIG. 3). In this arrangement, the problems of panel distortions and expansion rippling are greatly improved.

In all embodiments, the retention clip 40 may be bolted to a purlin or rafter constituting the support structure 44 with bolts 53 through the apertures 45. Typically, the head of the bolt 53 projects above the support surface 44 so that the panel 52 supported on this side of the retention clip 40 (i.e., on the flange 42) is lifted off the surface of the flange by a distance equal to the height of the bolt head. To compensate for this and ensure that the complementary panel 51 is level with the panel 52, at least one spacer 54 is provided on the upper surface of the flange 43. The height of the spacer 54 is the same as that of the bolt head thus ensuring that the lower surfaces of the two panels are level.

It should be stressed that the present invention is not limited to the structures illustrated in FIGS. 2 and 3. For example, spacer elements 60 may be located in one or both surfaces 49, 49' of the retention clip 40, have various shapes, oriented vertically, horizontally or otherwise, as partially illustrated in the examples in FIGS. 4 and 5. Thus, referring to FIG. 4 the retention clip 40 is a unitary construction formed of folded sheet metal such as stainless steel and spacer elements 60 are partially punched from the first wall surface 49 of the upright 50 and bent outward to form a pair of resilient fingers.

Figure 5:
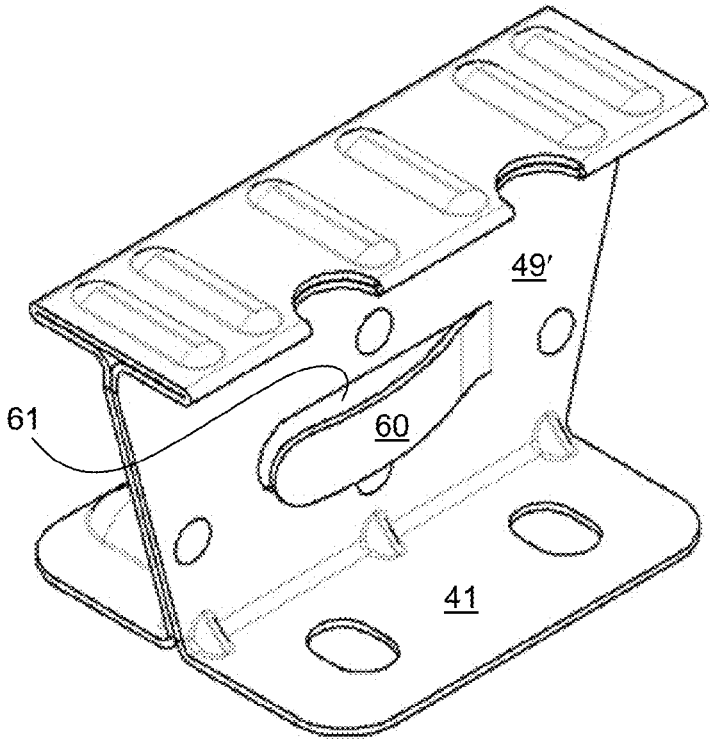

FIG. 5 shows a two-piece construction also formed of folded sheet metal, such as stainless steel, wherein an aperture 61 is formed in the first wall surface 49, typically by punching, and a single spacer element 60 in the form of a resilient finger is attached at a lateral edge to the retention clip 40. This may be done by crimping between the mating wall surfaces 49, 49' or soldering, welding, gluing etc. The resilient finger is bent outward to provide the required gap while being compressible upon thermal expansion of the juxtaposed panels.

It should be noted that in all embodiments the spacer element 60 must be sufficiently strong to withhold the attachment force applied by the person installing it and to resist the clamping pressure of the sealing cap 58. Yet it should also be compressible under the expansion forces applied by the heated panel. It may be elastic so that it resiliently springs back to its originally uncompressed form upon panel contraction.

Figure 4:
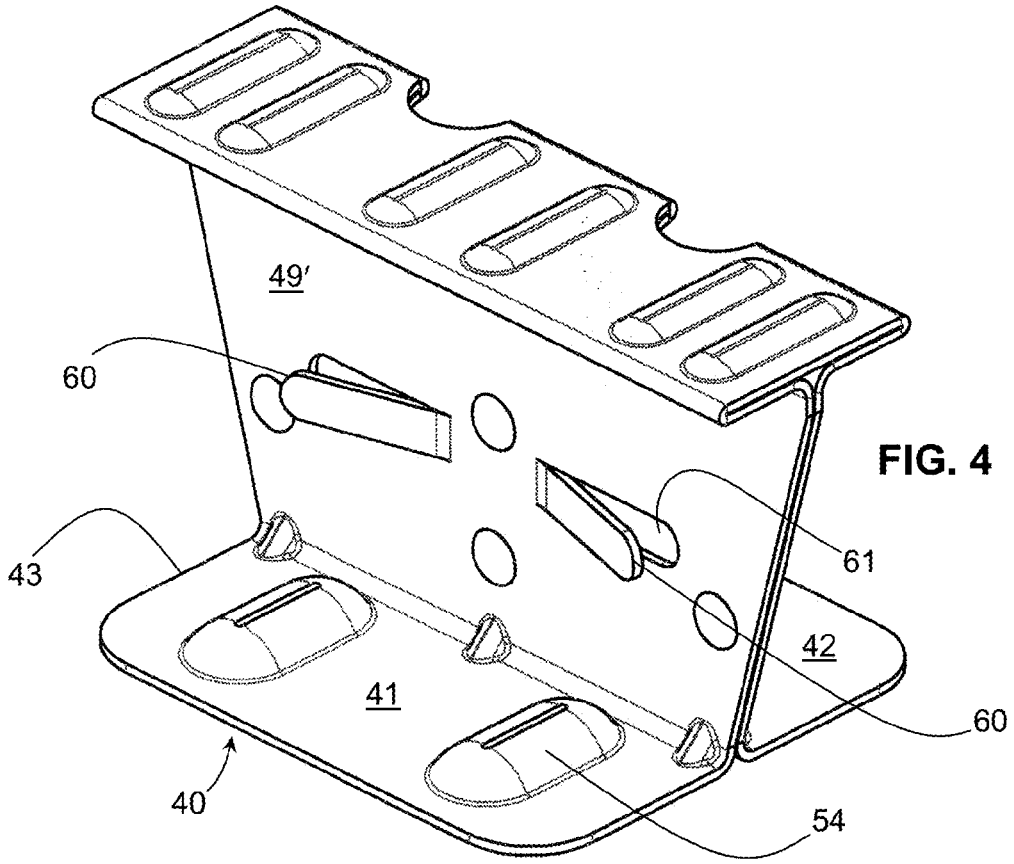
FIGS. 4 and 5 show pictorially retention clips according to other embodiments of the invention.

It should also be noted that while in FIGS. 4 and 5 the resilient fingers constituting the spacer elements 60 are oriented in a direction parallel to the base plate 41, they may equally be oriented in a direction normal to the base. In FIG. 5 only a single resilient finger is attached at its edge to an edge of the aperture. However, it will be appreciated that a pair of resilient fingers can be attached to opposing edges of the aperture, each spanning approximately half the length of the aperture. Also, more than one aperture may be provided each in association with one or more spacing elements.

Likewise, in all embodiments the retention clip 40 may be formed of folded sheet metal so as to form a unitary construction, to which the spacer elements 60 are then attached either fixedly or detachably. In some embodiments, such as shown in FIG. 5, the spacer elements 60 are also formed integrally to form a complete assembly of unitary construction.

FIGS. 6*a* and 6*b* show front and back views of an alternative retention clip 40 wherein the spacer elements 60 are detachable. To this end, opposite edges of the first wall surface 49 are provided with cutouts 62 for accommodating a peripheral groove 63 of a respective frangible tubular spacer element 60. During installation, the retention clip 40 is bolted to the support surface 44 with bolts 53 through the apertures 45 as shown in FIG. 3. The first panel 51 is then mounted with its end abutting the second wall surface 49' after which the second panel 52 is installed with its end abutting the free ends of the spacer elements 60. The spacer elements 60 are then broken off leaving a gap between the second panel 52 and the retention clip 40 which allows for free thermal expansion and contraction of the panels. The two panels 51 and 52 are then secured by snap-fitting the sealing cap 58 on the upwardly protruding flanges 56, 57, in known manner.

It is important to appreciate that the spacer elements 60 serve only to ensure that proper spacing is maintained between adjacent panels during assembly. Once the panels are placed side by side with sufficient mutual spacing to allow for thermal expansion without inducing buckling of the panels, the two panels are secured to a fixed structure, typically by means of self-tapping screws. Thereafter, the retention clip 40 serves no further purpose and may be removed or the spacer elements 60 may be detached.

While all the embodiments described so far are in the general form of an I-section, the retention clips shown in FIGS. 7*a*, 7*b* and 7*c* have a base that is in the general shape of an L-section. The retention clip 40 has a top plate 46 formed of a pair of opposing flanges 47 and 48 and is joined to the base plate 41 via an upright 50 extending between the base plate 41 and the top plate 46. The upright 50 defines opposing first and second surfaces, only one of which 49 is shown, that engage opposing first and second end faces of a pair of first and second adjacent panels 51 and 52 of a panel system 55 shown in FIG. 3 so as to allow mutual sliding of the panels relative to the retention clip 40, which is fixed to the structure 44. In use, the retention clip may be screwed to the fixed structure and the two adjacent panels may then be brought into alignment on opposite sides of the retention clip 40, which ensures that they are mutually displaced by a gap that is sufficient to allow for thermal expansion without inducing buckling of the panels. The panels are then screwed or otherwise attached to the fixed structure.

In addition to showing that the base plate 41 extends from only one side of the upright 50, the various embodiments of FIGS. 7*a*, 7*b* and 7*c* illustrate other features that may also be employed in the embodiments of FIGS. 2 to 6*a* and 6*b* as will now be described. Thus, while retention clip 40 may be formed as a unitary construction using folded metal it is to be understood that in all embodiments the base, upright and top portions may be formed separately and then assembled for example by welding. Also, while the upright 50 is shown in FIGS. 7*a* and 7*b* as having two juxtaposed walls, this is not a requirement and the upright 50 may have only a single wall as shown in FIG. 7*c*.

In the embodiments shown in FIGS. 2 to 6*b* the retention clip 40 is formed starting from the base plate 41, which is folded to form the upright 50, which is then folded to form the top plate 46. Clearly in all embodiments, the retention clip 40 may be formed by folding sheet metal to form first the top plate 46, then the upright and finally the base plate 41.

In the embodiments shown in FIGS. 4 and 7*b* where the upright 50 has two juxtaposed wall portions 49 and 49', both of the spacer elements 60 are shown as projecting from the same wall surface 49'. This requires that elongated U-slots are punched or otherwise formed in the wall surface 49', so as to leave residual fingers that are splayed outward to form the spacer elements 60 attached at one edge to the apertures 61. In this case, the adjacent wall surface 49 does not require that apertures be formed therein. This is stated for the sake of clarity since it is not apparent from the figures whether the apertures extend into only the forward wall surface or also into the rearward wall surface. But if desired the apertures may be formed in both wall surfaces. In this case there is nothing to prevent one of the spacer elements 60 projecting from the forward wall surface and the other spacer element projecting from the rearward wall surface through an aperture in the forward wall surface.

It should also be noted that while in FIGS. 7*b* and 7*c* the resilient fingers constituting the spacer elements 60 are oriented in a direction parallel to the base plate 41, they may equally be oriented in a direction normal to the base. Likewise, although only a single resilient finger is attached at its edge to an edge of the aperture, a pair of resilient fingers can be attached to opposing edges of the aperture, each spanning approximately half the length of the aperture. Also, more than one aperture may be provided each in association with one or more spacing elements.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A panel system, including a pair of adjacent spaced apart first and second panels secured to a support structure and a retention clip for maintaining a minimal gap between the panels during construction, wherein the retention clip comprises:

a base plate having at least one flange configured for attaching to the support structure;

a top plate having a pair of opposing flanges; and an upright extending between the base plate and the top plate and defining opposing first and second surfaces that in use are dimensioned to engage opposing first and second ends of the panels, a gap between the opposing first and second ends defining a lateral direction orthogonal to a plane parallel to the first and second ends of the panels;

wherein at least said first surface supports a resilient spacer element that is configured to maintain said minimal gap between the first end of the first panel and the first surface of the retention clip during construction of the panel system, wherein said spacer element is resiliently supported by the first surface of the upright so as to protrude outwardly from the first surface thereby defining said minimal gap and so that after construction of the panel system the spacer element is compressible under expansion forces applied by a heated panel so as to allow for thermal expansion of the panels in the lateral direction without inducing distortion or buckling of the panels.

2. The panel system according to claim 1, wherein the spacer element of the retention clip is configured for removal after securing the first panel so as to leave a gap between the first end of the first panel and the first surface.

3. The panel system according to claim 2, wherein the spacer element is frangibly attached to the upright.

4. The panel system according to claim 1, wherein:

the base plate of the retention clip has a pair of opposing flanges at least one of which is provided with attachment means for attaching to the support structure; and the respective flanges of the base plate and the top plate extend outwardly in mutually opposite directions from the upright.

5. The panel system according to claim 4 wherein:

the attachment means comprises one or more apertures in only a first one of said flanges of the base plate for accommodating therethrough respective bolts each having a bolt head; and a second one of the flanges is provided on an upper surface thereof with at least one spacer whose height is the same as that of the bolt head thus ensuring that the lower surfaces of the two panels are level when located on the respective flanges of the base plate.

6. The panel system according to claim 1, wherein at least the base plate, the top plate and the upright of the retention clip are formed of a unitary construction.

7. The panel system according to claim 1, wherein the base plate, the top plate and the upright of the retention clip are formed of folded sheet metal.

8. The panel system according to claim 7, wherein the spacer elements of the retention clip are partially punched from the first wall surface of the upright and bent outward to form a pair of resilient fingers.

9. The panel system according to claim 7, wherein an aperture is formed in the first wall surface of the retention clip and the spacer element is a resilient finger attached at an edge thereof to the retention clip at an edge of the aperture.

10. A retention clip for use with a panel system, said retention clip comprising:

a base plate having at least one flange configured for attaching to a support structure;

a top plate having a pair of opposing flanges; and an upright extending between the base plate and the top plate and defining opposing first and second surfaces that in use are dimensioned to engage opposing first and second ends of a pair of first and second adjacent panels;

wherein:

at least said first surface supports a spacer element that is configured to prevent mutual abutment of opposing ends of the first and second panels at least during construction of the panel system;

the base plate, the top plate and the upright are formed of folded sheet metal;

the spacer elements are partially punched from the first wall surface of the upright and bent outward to form a pair of resilient fingers;

the base plate has a pair of opposing flanges at least one of which is provided with attachment means for attaching to the support structure;

the respective flanges of the base plate and the top plate extend outwardly in mutually opposite directions from the upright;

the attachment means comprises one or more apertures in only a first one of said flanges of the base plate for accommodating therethrough respective bolts, each bolt having a bolt head; and a second one of the flanges is provided on an upper surface thereof with at least one spacer whose height is the same as that of the bolt head thus ensuring that the lower surfaces of the two panels are level when located on the respective flanges of the base plate.

11. The retention clip according to claim 10, wherein the upright has only a single wall portion.

12. The retention clip according to claim 10, wherein the upright has two juxtaposed wall portions, and a pair of said spacer elements project from a surface of only one said walls.

13. The retention clip according to claim 10, wherein the upright has two juxtaposed wall portions, and spacer elements project from respective surfaces of both walls such that the spacer element that projects from a first of said walls also projects through an aperture in a second of said walls.

14. The retention clip according to claim 10, wherein the base plate has a pair of opposing flanges at least one of which is configured for attaching to the support structure.

15. The retention clip according to claim 10, wherein the base plate has a single flange that forms a generally L-shape with the upright.

16. The retention clip according to claim 10, wherein the spacer element is configured for removal after securing the first panel so as to leave a gap between the first end of the first panel and the first surface.

17. The retention clip according to claim 10, wherein the spacer element is frangibly attached to the upright.

18. The retention clip according to claim 10, wherein the spacer element is resiliently supported by the first surface of the upright so as to protrude outwardly from the first surface, thereby defining a gap between the first end of the first panel and the first surface.

19. The retention clip according to claim 10, wherein at least the base plate, the top plate and the upright of the retention clip are formed of a unitary construction.

20. The retention clip according to claim 10, wherein an aperture is formed in the first wall surface and the spacer element is a resilient finger attached at an edge thereof to an edge of the aperture.

* * * * *